US011100839B2

(12) United States Patent
Ono et al.

(10) Patent No.: US 11,100,839 B2
(45) Date of Patent: Aug. 24, 2021

(54) NOISE COMPENSATION FOR DISPLAYS WITH NON-RECTANGULAR BORDERS

(71) Applicant: Apple Inc., Cupertino, CA (US)

(72) Inventors: Shinya Ono, Cupertino, CA (US); Chin-Wei Lin, San Jose, CA (US); Jie Won Ryu, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/746,288

(22) Filed: Jan. 17, 2020

(65) Prior Publication Data

US 2020/0302853 A1 Sep. 24, 2020

Related U.S. Application Data

(60) Provisional application No. 62/822,447, filed on Mar. 22, 2019.

(51) Int. Cl.
*G09G 5/00* (2006.01)
*G09G 3/20* (2006.01)

(52) U.S. Cl.
CPC ..... *G09G 3/2074* (2013.01); *G09G 3/2003* (2013.01); *G09G 2300/0408* (2013.01); *G09G 2300/0426* (2013.01); *G09G 2310/0278* (2013.01); *G09G 2320/0209* (2013.01)

(58) Field of Classification Search
CPC ..... G06F 3/038; G09G 5/00
See application file for complete search history.

(56) References Cited

U.S. PATENT DOCUMENTS

| | | | | |
|---|---|---|---|---|
| 8,144,281 | B2 | 3/2012 | Nakagawa | |
| 8,441,606 | B2 | 5/2013 | Nakagawa et al. | |
| 8,514,160 | B2 | 8/2013 | Huang et al. | |
| 10,810,937 | B2 * | 10/2020 | Hwang | G09G 3/3266 |
| 2009/0153530 | A1 | 6/2009 | Chen et al. | |
| 2015/0138177 | A1 * | 5/2015 | Kwon | G09G 3/3233 345/211 |
| 2015/0220206 | A1 * | 8/2015 | Knausz | G06F 3/0446 345/174 |
| 2018/0062107 | A1 * | 3/2018 | Kim | G09G 3/3258 |
| 2019/0304366 | A1 * | 10/2019 | Ka | H01L 27/3262 |

* cited by examiner

*Primary Examiner* — Pegeman Karimi
(74) *Attorney, Agent, or Firm* — Fletcher Yoder P.C.

(57) ABSTRACT

The present disclosure relates to an electronic device that includes a display that has a plurality of scan lines. The display also includes a first data line that has a first number of pixels. The first data line forms a first number of crossovers with the plurality of scan lines. Additionally, the display includes a second data line that has a second number of pixels that is different than the first number of pixels. The second data line forms a second number of crossovers with the plurality of scan lines that is equal to the first number of crossovers.

20 Claims, 8 Drawing Sheets

NOISE COMPENSATION FOR DISPLAYS WITH NON-RECTANGULAR BORDERS

CROSS-REFERENCE TO RELATED APPLICATIONS

This application claims priority to U.S. Provisional Patent Application No. 62/822,447, entitled "Noise Compensation for Displays with Non-Rectangular Borders," filed on Mar. 22, 2019, which is incorporated herein by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Display panel uniformity may be negatively impacted by various parameters (e.g., aging, temperature, process variation) of the display panel. The display panel uniformity may be improved by sensing non-uniformity properties due to operational variations in a display. Using the sensed non-uniformity properties, image data may be adjusted to account for non-uniformity before the image data is displayed on the display. The adjustments to the image data may be performed in circuitry external to the electronic display, such as in a processor core complex of an electronic device to which the electronic display belongs. As such, the adjustments to the image data may be referred to as "external compensation." It should be understood, however, that these adjustments may take place in circuitry internal to an electronic display module or even in circuitry external to the electronic device to which the electronic display belongs. For example, the adjustments to the image data may take place on a different electronic device, such as in a remote server, based on sensed non-uniformity properties of the display.

The non-uniformity properties of the electronic display that can be used as a basis for adjusting the image data to achieve display uniformity may include any suitable properties of pixel circuitry that impact the behavior of the pixels of the electronic display. Non-limiting examples include transistor threshold voltages, transistor current-voltage curves, pixel currents or voltages in response to test signals, to name just a few, since these may vary with process, temperature, or pixel aging. Non-uniformity properties such as these may be sensed using sense lines associated with pixels of the electronic display. In some cases, data lines that supply the image data to the pixels may be used as sense lines.

For devices with bezels or displays that have rounded or angled edges, sensing pixels of the display panel via the data lines may be negatively impacted by data lines forming crossovers (e.g., intersecting) with differing numbers of scan lines, which may be generally orthogonal to the data lines. For example, when data lines form crossovers with different numbers of scan lines, different amounts of noise may be introduced to the data lines, which may negatively impact display panel uniformity and/or which may introduce noise into signals that are sensed that relate to non-uniformity properties of a display. As discussed below, portions of scan lines may be included to maintain the same number of crossovers for different data lines. The portions of the scan lines may be disposed between pixels or even outside of a display of an electronic device (e.g., near a rounded portion of the display) to enable data lines to form the same number of crossovers with the scan lines.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
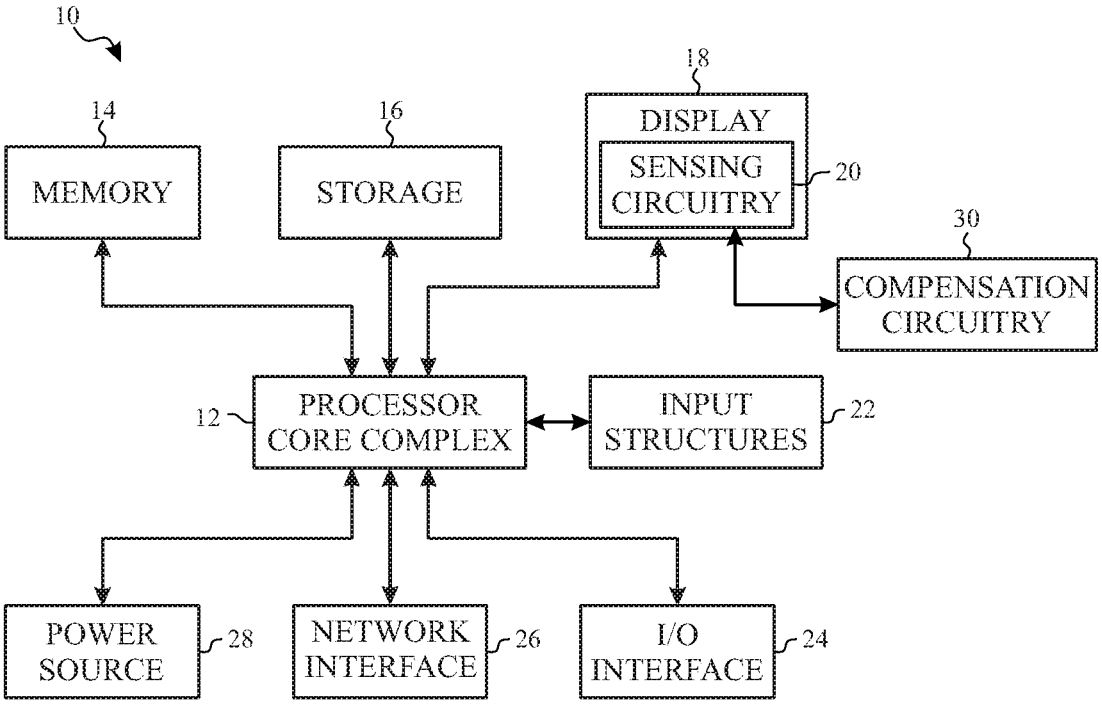
FIG. 1 is a schematic block diagram of an electronic device including a display with sensing and compensation circuitry, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "including" and "having" are intended to be inclusive and mean that there may be additional elements other than the listed elements. Additionally, it should be understood that references to "some embodiments," "embodiments," "one embodiment," or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Display panel uniformity can be improved by sensing and compensating for non-uniformity properties or characteristics in a display, which may occur at or around a time of manufacture of the electronic device or while the electronic device is being used. The sensing may detect and be used to compensate for non-uniform display properties, such as variations in transistor threshold voltages, transistor current-voltage curves, pixel currents or voltages in response to test signals, to name a few. For devices with bezels or displays that have rounded or angled edges, display panel uniformity may be negatively impacted by data lines forming crossovers (e.g., intersecting) with differing numbers of scan lines.

For example, when data lines form crossovers with different numbers of scan lines, different amounts of noise may be introduced to the data lines, which may negatively impact display panel uniformity. As discussed below, portions of scan lines may be included to maintain the same number of crossovers for different data lines. The portions of the scan lines may be disposed between pixels or even be disposed outside of a display of an electronic device (e.g., near a rounded or angled portion of the display) to enable data lines to form the same number of crossovers with the scan lines.

Figure 2:
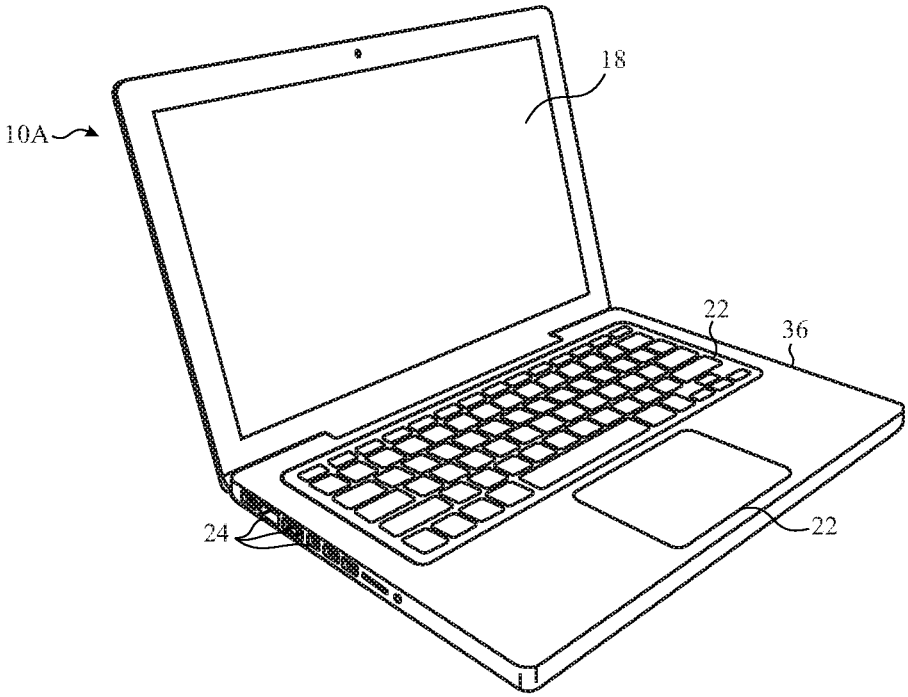
FIG. 2 is a perspective view of a notebook computer representing an embodiment of the electronic device of FIG. 1.
Figure 4:
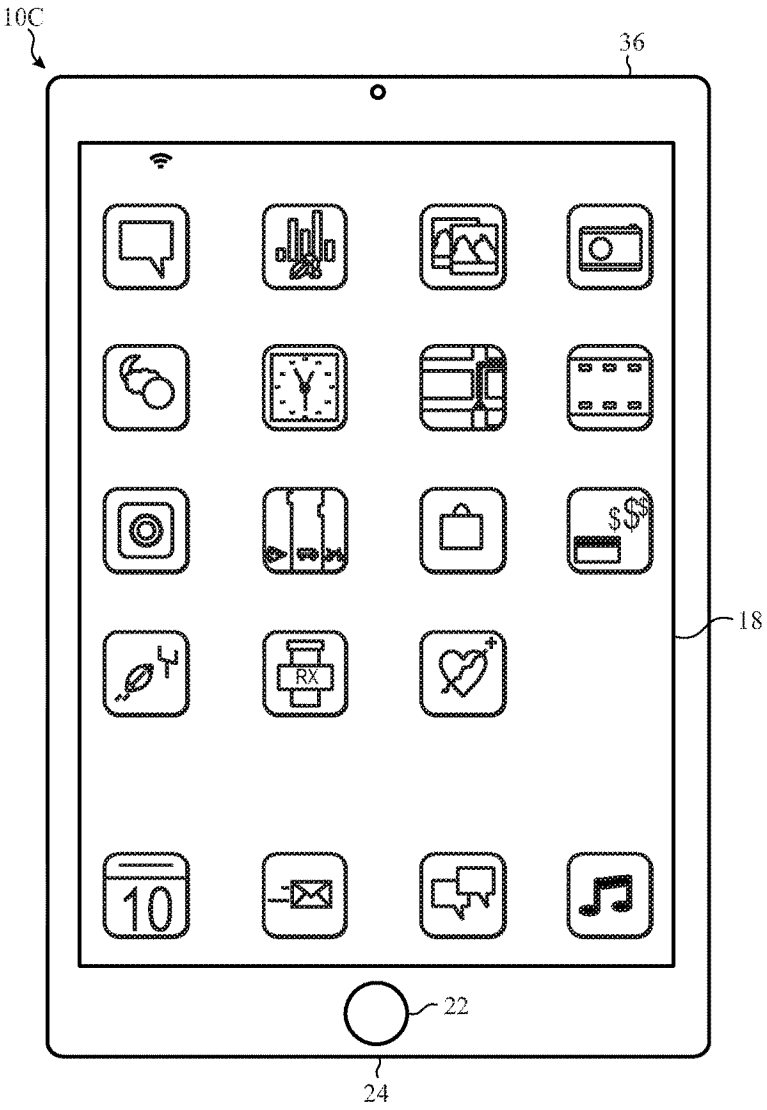
FIG. 4 is a front view of another hand-held device representing another embodiment of the electronic device of FIG. 1.
Figure 3:
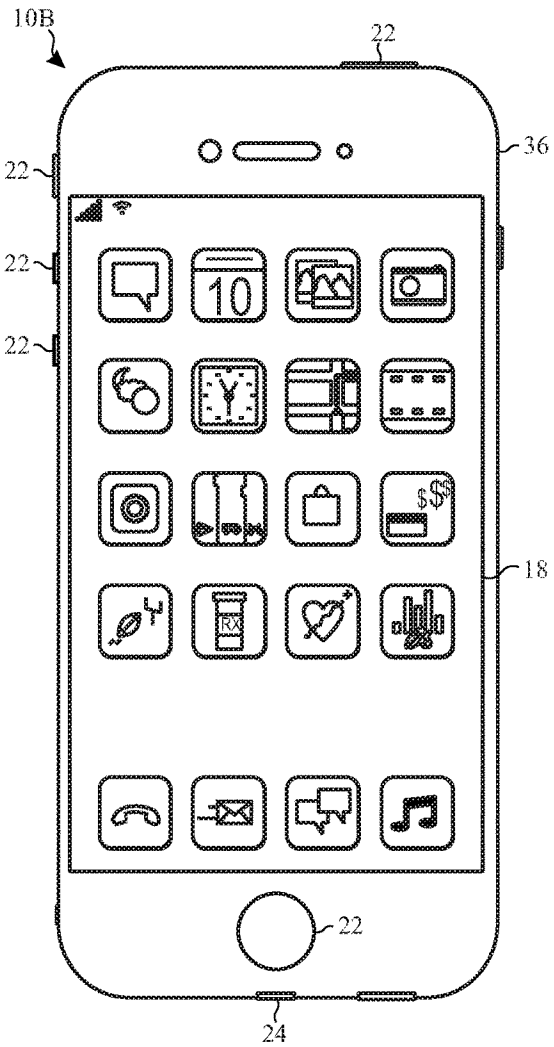
FIG. 3 is a front view of a hand-held device representing another embodiment of the electronic device of FIG. 1.
Figure 5:
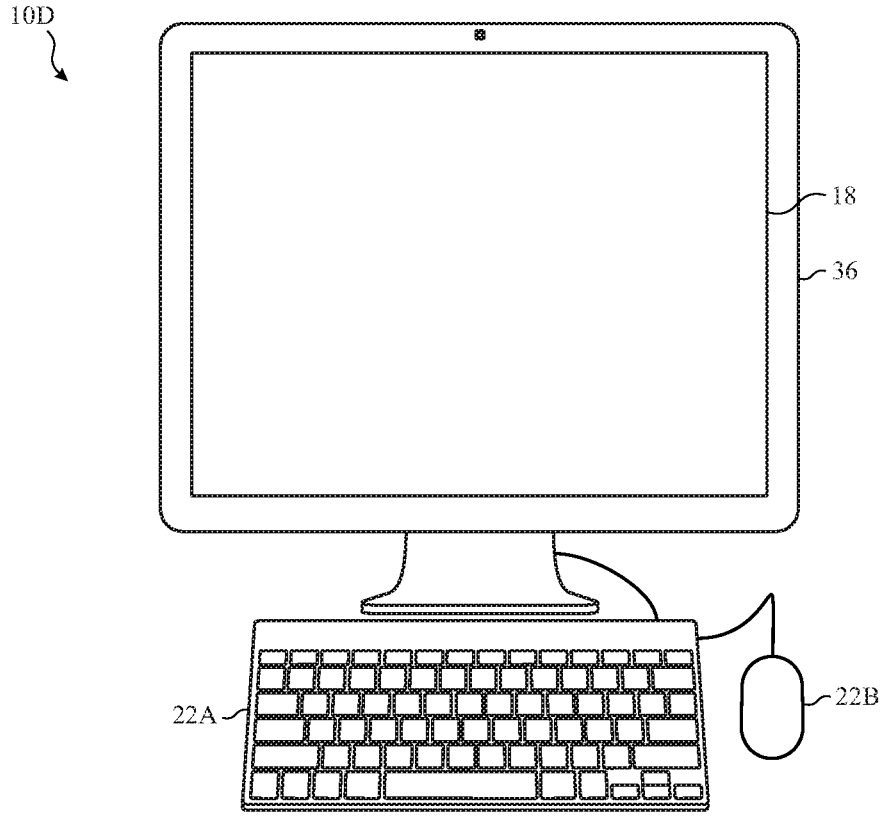
FIG. 5 is a front view of a desktop computer representing another embodiment of the electronic device of FIG. 1.
Figure 6:
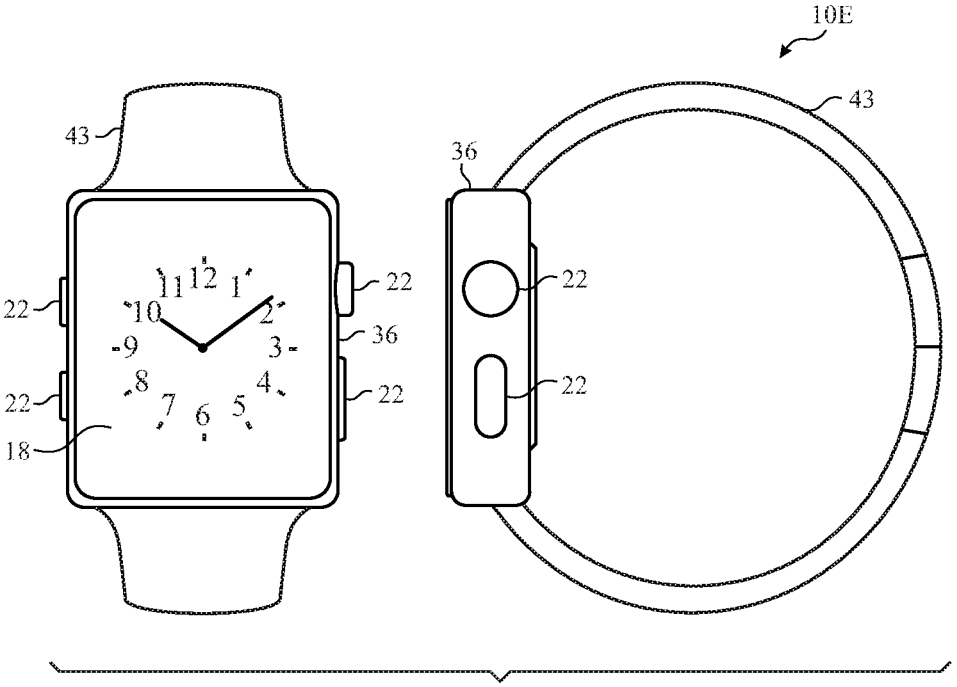
FIG. 6 is a front view and side view of a wearable electronic device representing another embodiment of the electronic device of FIG. 1.

A general description of suitable electronic devices that may include a self-emissive display, such as an LED (e.g., an OLED) display, and corresponding circuitry of this disclosure are provided. With this in mind, a block diagram of an electronic device 10 is shown in FIG. 1. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or a similar device.

The electronic device 10 shown in FIG. 1 may include, for example, a processor core complex 12, a local memory 14, a main memory storage device 16, an electronic display 18, sensing circuitry 20, input structures 22, an input/output (I/O) interface 24, network interfaces 26, a power source 28, and compensation circuitry 30. The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as provide image data for display on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diodes (OLED) display, or may be a liquid crystal display (LCD) illuminated by a backlight. In some embodiments, the electronic display 18 may include a touch screen, which may allow users to interact with a user interface of the electronic device 10. The electronic display 18 may include sensing circuitry 20 that is used to sense non-uniformity of the electronic display 18 by sensing changes in one or more parameters (e.g., voltage/current) through thin-film transistors (TFTs) and/or emissive elements in the electronic display 18. These parameters may include any suitable properties of pixel circuitry that impact the behavior of the pixels of the electronic display. Non-limiting examples include transistor threshold voltages, transistor current-voltage curves, pixel currents or voltages in response to test signals, to name just a few, since these may vary with process, temperature, or pixel aging.

As previously noted, the sensing circuitry 20 may provide indications of these sensed parameters to compensation circuitry 30 that stores and compensates for sensed non-uniformity. In some embodiments, the compensation circuitry 30 may be embodied in the processor core complex 12 (e.g., as described with reference to FIG. 8). Similarly, in certain embodiments, the compensation circuitry 30 may store the compensation values in the local memory 14, main memory storage device 16, and/or locally within the compensation circuitry 30. The compensation circuitry 30 may compensate image data for sensed non-uniformity so that when the image data is displayed on the electronic display 18, the effects of the non-uniformity of the display are reduced or eliminated. For example, where the sensed parameters indicate a pixel on the display displays the same image data less brightly than other pixels, image data for that pixel may be adjusted to be brighter in compensation. Likewise, where the sensed parameters indicate a pixel on the display displays the same image data more brightly than other pixels, image data for that pixel may be adjusted to be less bright in compensation. Additionally or alternatively, the compensation circuitry 30 may provide to the sensing circuitry 20 a reference current that may be used by the sensing circuitry 20 to internally sense non-uniformity in the electronic display 18 (e.g., aging of TFTs and/or emissive elements).

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal serial bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as input structures 22A or 22B (e.g., keyboard and mouse), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
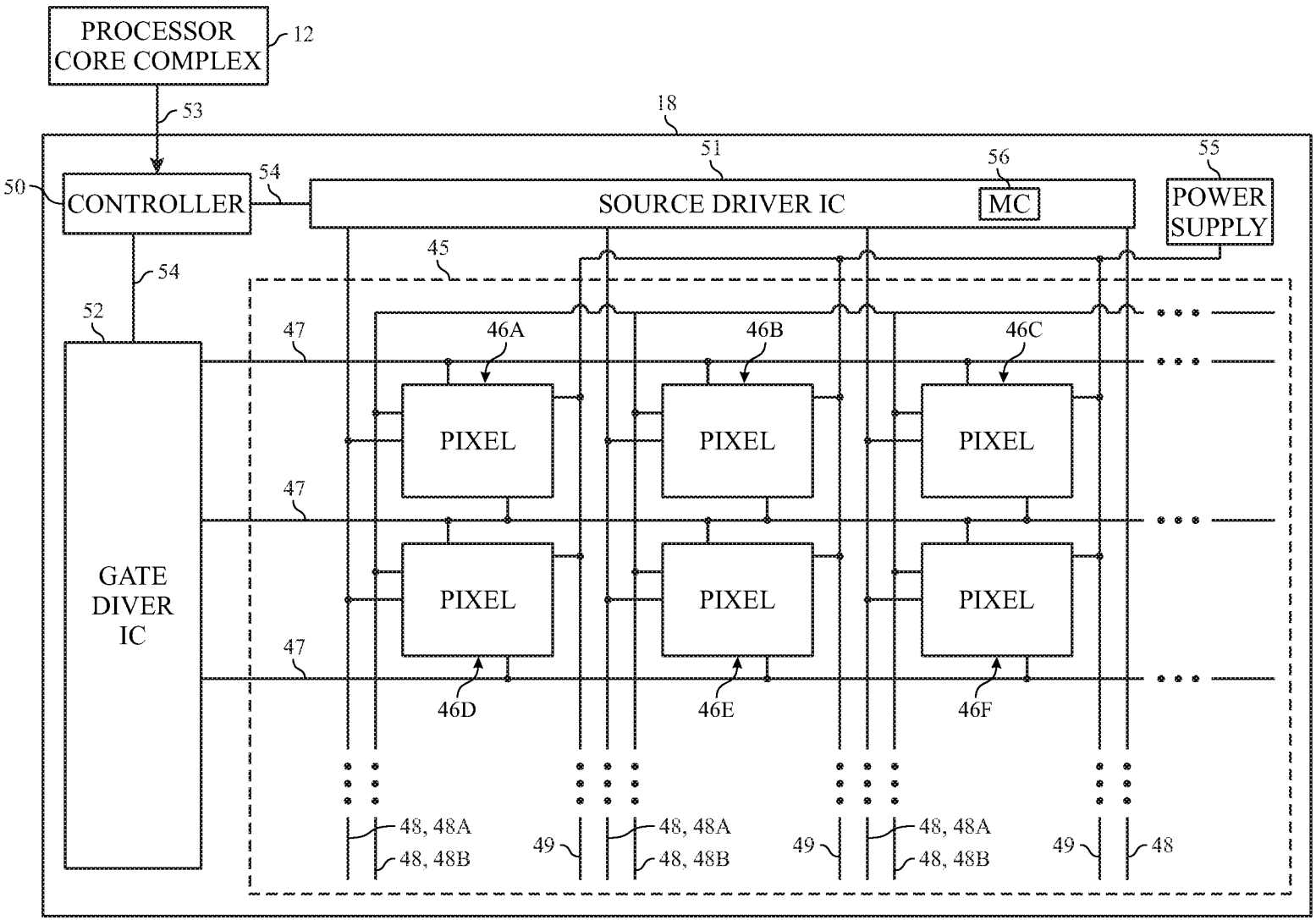
FIG. 7 is a circuit diagram illustrating a portion of an array of pixels of the display of FIG. 1, in accordance with an embodiment.

The electronic display 18 for the electronic device 10 may include a matrix of pixels that contain light-emitting circuitry. Accordingly, FIG. 7 illustrates a circuit diagram including a portion of a matrix of pixels in an active area of the electronic display 18. As illustrated, the electronic display 18 may include a display panel 45. Moreover, the display panel 45 may include multiple unit pixels 46 (here, six unit pixels 46A, 46B, 46C, 46D, 46E, and 46F are shown) arranged as an array or matrix defining multiple rows and columns of the unit pixels 46 that collectively form a viewable region of the electronic display 18, in which an image may be displayed. In such an array, each unit pixel 46 may be defined by the intersection of rows and columns, represented here by the illustrated gate lines 47 (also referred to as "scanning lines") and data lines 48 (also referred to as "source lines"), respectively. Additionally, power supply lines 49 may provide power to each of the unit pixels 46 (e.g., from power supply 55). The unit pixels 46 may include, for example, a thin film transistor (TFT) coupled to a self-emissive pixel, such as an OLED, whereby the TFT may be a driving TFT that facilitates control of the luminance of a display pixel 46 by controlling a magnitude of supply current flowing into the OLED of the display pixel 46 or a TFT that controls luminance of a display pixel by controlling the operation of a liquid crystal.

Although only six unit pixels 46, referred to individually by reference numbers 46A-46F, respectively, are shown, it should be understood that in an actual implementation, each data line 48 and gate line 47 may include hundreds or even thousands of such unit pixels 46. By way of example, in a color display panel 45 having a display resolution of 1024×768, each data line 48, which may define a column of the pixel array, may include 768 unit pixels, while each gate line 47, which may define a row of the pixel array, may include 1024 groups of unit pixels with each group including a red, blue, and green pixel, thus totaling 3072 unit pixels per gate line 47. It should be readily understood, however, that each row or column of the pixel array any suitable number of unit pixels, which could include many more pixels than 1024 or 768. In the presently illustrated example, the unit pixels 46 may represent a group of pixels having a red pixel (62A), a blue pixel (62B), and a green pixel (62C). The group of unit pixels 46D, 46E, and 46F may be arranged in a similar manner. Additionally, in the industry, it is also common for the term "pixel" may refer to a group of adjacent different-colored pixels (e.g., a red pixel, blue pixel, and green pixel), with each of the individual colored pixels in the group being referred to as a "sub-pixel." In some cases, however, the term "pixel" refers generally to each sub-pixel depending on the context of the use of this term.

As illustrated, the electronic display 18 may include an array of pixels 46 (e.g., self-emissive pixels). The electronic display may include any suitable circuitry to drive the pixels 46. In the example of FIG. 7, the electronic display 18 includes a controller 50, a source driver integrated circuit (IC) 51, and a gate driver IC 52. The source driver IC 51 and gate driver IC 52 may drive individual of the self-emissive pixels 46. In some embodiments, the source driver IC 51 and the gate driver IC 52 may include multiple channels for independently driving multiple of the self-emissive pixel 46. Each of the pixels 46 may include any suitable light-emitting element, such as a LED, one example of which is an OLED. However, any other suitable type of pixel, including non-self-emissive pixels (e.g., liquid crystal, digital micromirror) may also be utilized.

The controller 50, which may include a chip, such as a processor or application specific integrated circuit (ASIC), that controls various aspects (e.g., operation) of the electronic display 18 and/or the display panel 45. For instance, the controller 50 may receive image data 53 from the processor core complex indicative of light intensities for the light outputs for the pixels 46. In some embodiments, the controller 50 may be coupled to the local memory 14 and retrieve the image data 53 from the local memory 14. The controller 50 may control the pixels 46 by using control signals to control elements of the pixels 46. For instance, the pixels 46 may include any suitable controllable element, such as a transistor, one example of which is a MOSFET. The pixels 46, which may be self-emissive, may include any suitable controllable element, such as a transistor, one example of which is a MOSFET. However, any other suitable type of controllable elements, including thin film transistors (TFTs), p-type and/or n-type MOSFETs, and other transistor types, may also be used. The controller 50 may control elements of the pixels 46 via the source driver IC70 and the gate driver IC 52. For example, the controller 50 may send signals to the source driver IC 51, which may send signals (e.g., timing information/image signals 54) to the pixels 46. The gate driver IC 52 may provide/remove gate activation signals to activate/deactivate rows of unit pixels 46 via the gate lines 47 based on timing information/image signals 54 received from the controller 50.

In some embodiments, the controller 50 may be included in the source driver IC 51. Additionally, the controller 50 or source driver IC 51 may include a timing controller (TCON) that determines and sends the timing information/image signals 54 to the gate driver IC 52 to facilitate activation and deactivation of individual rows of unit pixels 46. In other embodiments, timing information may be provided to the gate driver IC 52 in some other manner (e.g., using a controller 56 that is separate from or integrated within the source driver IC 51). Further, while FIG. 7 depicts only a controller 50 and a single source driver IC 51, it should be appreciated that other embodiments may utilize multiple controllers 69 and/or multiple source driver ICs 70 to provide timing information/image signals 54 to the unit pixels 46. For example, additional embodiments may include multiple controller 50 and/or multiple source driver ICs 70 disposed along one or more edges of the display panel 45, with each controller 50 and/or source driver IC 51 being configured to control a subset of the data lines 48 and/or gate lines 47.

In addition, in some embodiments, sensing circuitry may be included in the gate driver IC 52 and/or the source driver IC 51 to measure pixel parameters or perform pixel parameter adjustments (e.g., adjustment of control signals transmitted to one or more pixels 46) as part of non-uniformity correction operations and/or error correction operations. However, it should be appreciated that this sensing circuitry may also be disposed external and/or the pixel parameter adjustments performed external, such as in an externally disposed processor core complex 12, to the gate driver IC 52 and/or the source driver IC 51 to perform external compensation operations.

Figure 8:
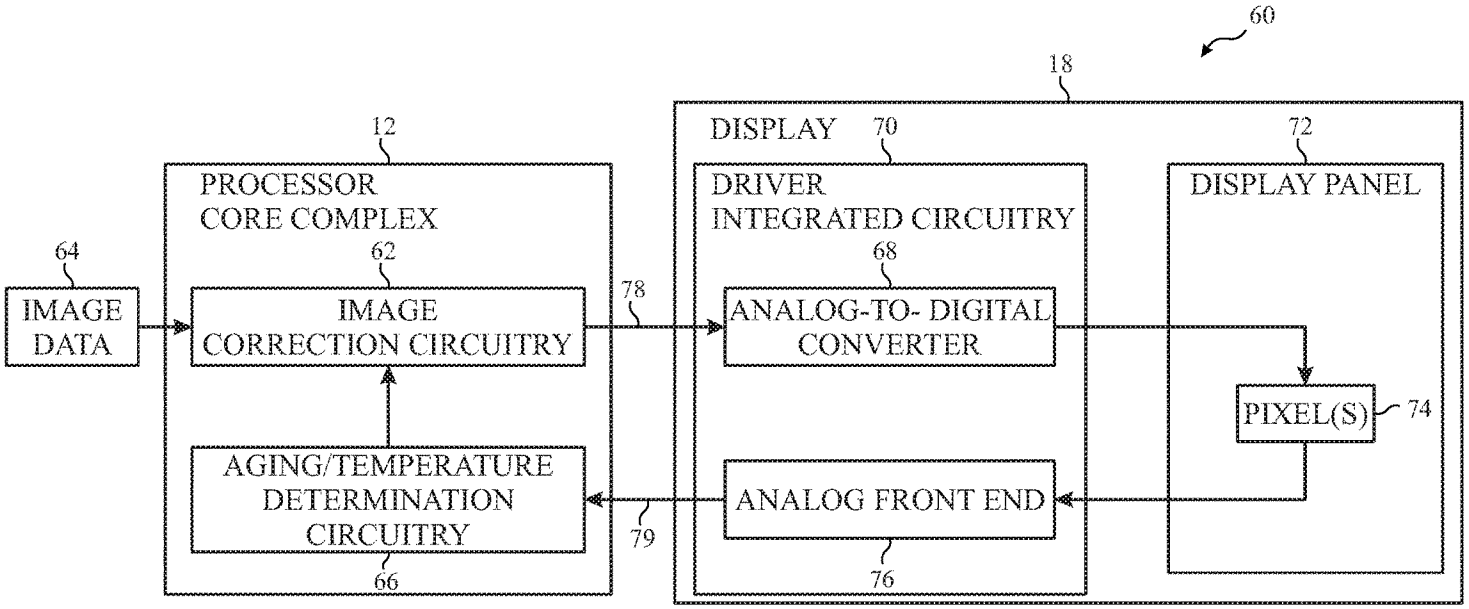
FIG. 8 is a block diagram of a system for display sensing and compensation, according to an embodiment of the present disclosure.

FIG. 8 is a block diagram of a system 60 for display sensing and compensation, according to an embodiment of the present disclosure. The system 60 includes the processor core complex 12, which includes image correction circuitry 62. The image correction circuitry 62, which may correspond to the compensation circuitry 30 of FIG. 1, may receive image data 64 and compensate for non-uniformity of the electronic display 18 based on and induced by process non-uniformity temperature gradients, aging of the electronic display 18, and/or other factors across the electronic display 18 to increase performance of the electronic display 18 (e.g., by reducing visible anomalies). The non-uniformity of pixels in the electronic display 18 may vary between devices of the same type (e.g., two similar phones, tablets, wearable devices, or the like), over time and usage (e.g., due to aging and/or degradation of the pixels or other components of the electronic display 18), and/or with respect to temperatures, as well as in response to additional factors.

As illustrated, the system 60 includes aging/temperature determination circuitry 66 that may determine or facilitate determining the non-uniformity of the pixels in the electronic display 18 due to, for example, aging and/or degradation of the pixels or other components of the electronic display 18. The aging/temperature determination circuitry 66, which may represent an element of the compensation circuitry 30 of FIG. 1, may also determine or facilitate determining the non-uniformity of the pixels in the electronic display 18 due to, for example, temperature or aging.

The image correction circuitry 62 may send the image data 64 (for which the non-uniformity of the pixels in the electronic display 18 have or have not been compensated for by the image correction circuitry 62) to analog-to-digital converter 68 of a driver integrated circuit 70 of the electronic display 18. The analog-to-digital conversion converter 68 may digitize then image data 64 when it is in an analog format. The driver integrated circuit 70 may send signals across gate lines to cause a row of pixels of a display panel 72, including one or more pixels 74 which may be included among the pixels 46 of FIG. 7, to become activated and programmable, at which point the driver integrated circuit 70 may transmit the image data 64 across data lines to program the pixels of the display panel 72 to display a particular gray level (e.g., individual pixel brightness). By supplying different pixels of different colors with the image data 64 to display different gray levels, full-color images may be programmed into the pixels. The driver integrated circuit 70 may also include a sensing analog front end 76 to perform analog sensing of the response of the pixels to data input (e.g., the image data 64) to the pixels. The analog front end 76 may be included in the sensing circuitry 20 of FIG. 1.

The processor core complex 12 may also send sense control signals 78 to cause the electronic display 18 to perform display panel sensing. In response, the electronic display 18 may send display sense feedback 79 that represents digital information relating to the operational variations of the electronic display 18. The display sense feedback 79 may be input to the aging/temperature determination circuitry 66, and take any suitable form. Output of the aging/temperature determination circuitry 66 may take any suitable form and be converted by the image correction circuitry 62 into a compensation value that, when applied to the image data 64, appropriately compensates for non-uniformity of the electronic display 18. This may result in greater fidelity of the image data 64, reducing or eliminating visual artifacts that would otherwise occur due to the operational variations of the electronic display 18. In some embodiments, the processor core complex 12 may be part of the driver integrated circuit 70, and as such, be part of the electronic display 18.

Figure 9:
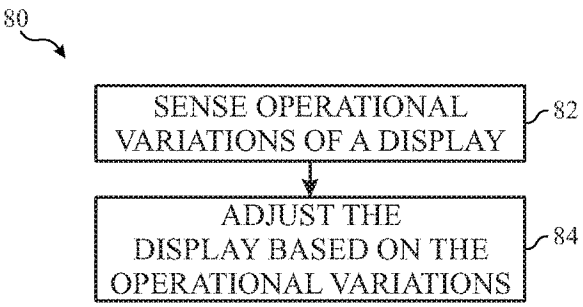
FIG. 9 is a flowchart illustrating a process for display sensing and compensation using the system of FIG. 8, according to an embodiment of the present disclosure.

FIG. 9 is a flowchart illustrating a process 80 for display sensing and compensation using the system 60 of FIG. 8, according to an embodiment of the present disclosure. The process 80 may be performed by any suitable device that may sense operational variations of the electronic display 18 and compensate for the operational variations, such as the electronic display 18 and/or the processor core complex 12.

The electronic display 18 senses (process block 82) operational variations of the electronic display 18 itself. In particular, the processor core complex 12 may send one or more instructions (e.g., sense control signals 78) to the electronic display 18. The instructions may cause the electronic display 18 to perform display panel sensing. The operational variations may include any suitable variations that induce non-uniformity in the electronic display 18, such as process non-uniformity temperature gradients, aging of the electronic display 18, and the like.

The processor core complex 12 then adjusts (process block 84) the electronic display 18 based on the operational variations. For example, the processor core complex 12 may receive display sense feedback 79 that represents digital information relating to the operational variations from the electronic display 18 in response to receiving the sense control signals 78. The display sense feedback 79 may be input to the aging/temperature determination circuitry 66, and take any suitable form. Output of the aging/temperature determination circuitry 66 may take any suitable form and be converted by the image correction circuitry 62 into a compensation value. For example, processor core complex 12 may apply the compensation value to the image data 64, which may then be sent to the electronic display 18. In this manner, the processor core complex 12 may perform the process 80 to increase performance of the electronic display 18 (e.g., by reducing visible anomalies).

As noted above, the present disclosure relates to sensing and compensation circuitry that may be included in an electronic device (e.g., the sensing circuitry 20 and compensation circuitry 30 of the electronic device 10). As discussed below, in some embodiments of the electronic device 10, especially those with non-rectangular displays 18 (e.g., an electronic display 18 that includes curved or non-linear portions such as edges), interference, such as noise, may be introduced due to a data line associated with one or more pixels crossing over a different number of scan lines than a data line associated with one or more other pixels. Similarly, interference may also be caused by scan lines crossing over a different numbers of data lines. As discussed below, reducing imbalances in the number of crossovers may reduce the occurrence of display discrepancies, such as visual artifacts.

Figure 10:
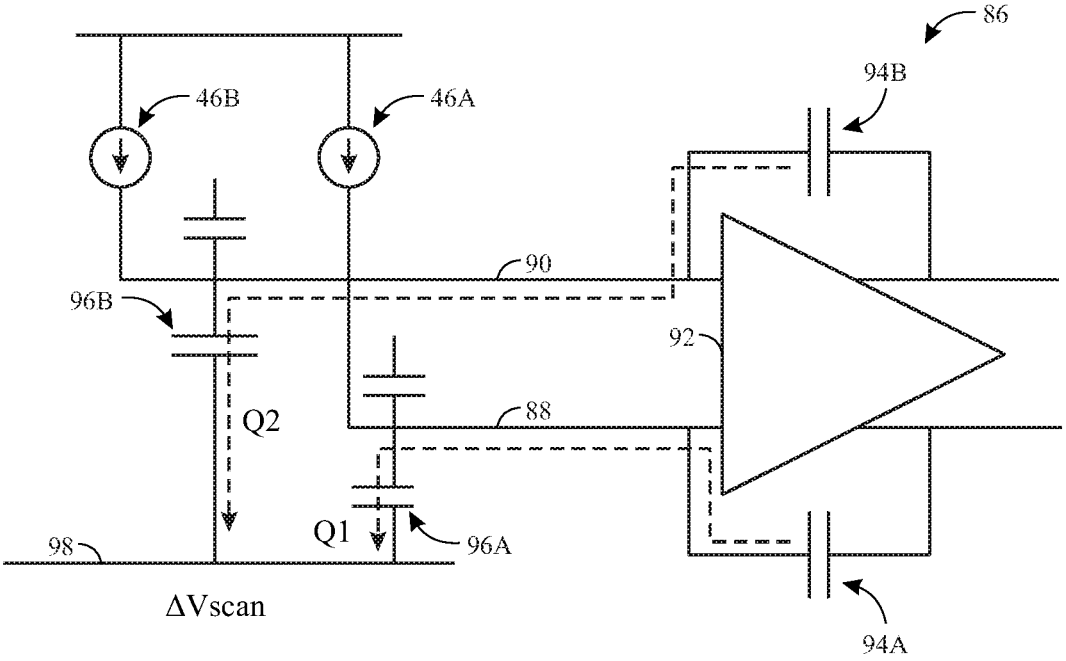
FIG. 10 is a schematic diagram of circuitry that may be included in the electronic device of FIG. 1, in accordance with an embodiment.

Bearing this in mind, FIG. 10 is a schematic diagram of differential sensing circuitry 86 that may be used to sense parameters of pixels of the display while cancelling common mode noise. In the example of FIG. 10, the differential sensing circuitry 86 may be used to differentially sense a pixel 46A on a data line 88 in comparison to a pixel 46B on a data line 90, or vice versa. The data lines 88 and 90 are coupled to a comparator 92 that can sense differences between voltages that arise on integrating capacitors 94A and 94B due to current on the data lines 88 and 90, respectively. When the data lines 88 and 90 have the same or similar loading characteristics, common mode noise that appears on both of the data lines 88 and 90 (e.g., due to a common environmental noise source, such as display scanning signals or electromagnetic interference (EMI) from other circuitry of the electronic device 10) may be substantially the same on both data lines 88 and 90, and thus this common mode noise may cancel out in the comparator 92. Therefore, when the data lines 88 and 90 have the same or substantially similar loading characteristics, the differential sensing circuitry 86 may be used to sample a difference in the electrical behavior of the pixel 46A (e.g., in response to a test data signal) as compared to the pixel 46B (e.g., which may be off), while noise that is common to both data lines 88 and 90 cancels out. The result is the electrical behavior of the pixel 46A without the common mode noise.

Yet while the noise on the data lines 88 and 90 may cancel out when the data lines 88 and 90 have the same loading characteristics, this may not be the case when the data lines 88 and 90 have different loading characteristics. Indeed, if a parasitic capacitance 96A between the data line 88 and a scan line 98 differs from a parasitic capacitance 96B between the data line 90 and the scan line 98, unequal noise due to a scanning signal (ΔVscan) on the scan line 98 may arise. For example, first noise due to a first charge Q1 may occur on the data line 88 that may differ from second noise due to a second charge Q2 on the data line 90. Since this noise is unequal, the noise will not cancel out in the comparator 92. For example, the amount of residual noise may be related to a difference between Q1 and Q2. This difference may be described as a difference in capacitance between the capacitors 96 multiplied by a change in voltage occurring on of the scan line 98 due to the scanning signal (ΔVscan).

An electronic display 18 that includes irregular or non-rectangular borders may have different numbers of pixels 46 on each data line and, accordingly, different numbers of scan line crossovers. Since the different number of scan line crossovers may affect the parasitic capacitance (e.g., 96A and 96B in the example of FIG. 10), unequal noise due to a scanning signal (ΔVscan) on the scan line 98 may arise. For example, as discussed above, first noise due to a first charge Q1 may occur on the data line 88 that may differ from second noise due to a second charge Q2 on the data line 90. Because this noise is unequal, the noise will not cancel out in the comparator 92, which may cause inaccurate non-uniformity correction operations to be performed.

Figure 11:
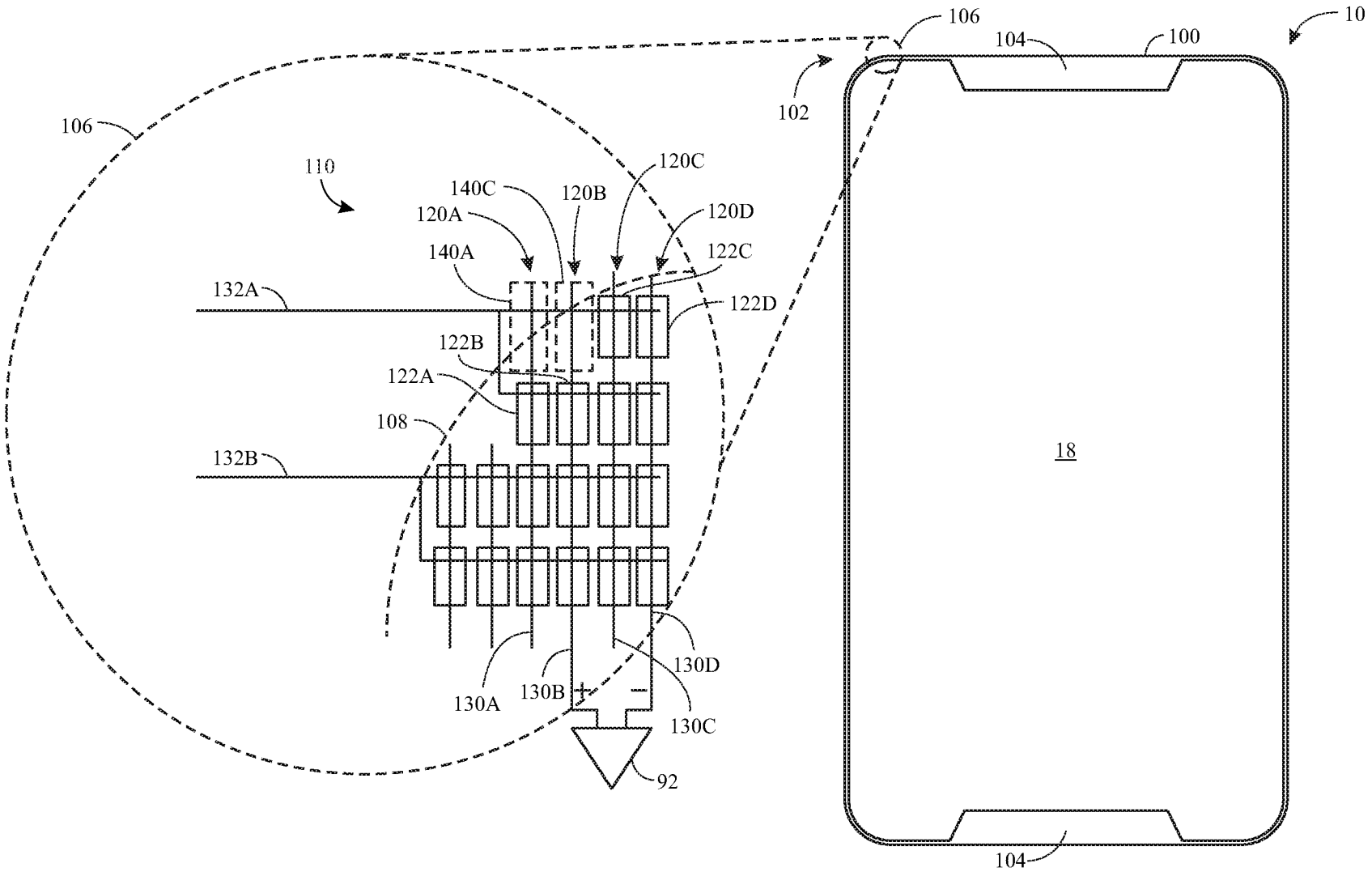
FIG. 11 illustrates the electronic device of FIG. 1 and circuitry that may be included within the electronic device, in accordance with an embodiment.

Keeping the discussion of FIG. 10 in mind, FIG. 11 is a schematic diagram of an embodiment of the electronic device 10. More specifically, in the illustrated embodiment, the electronic device 10 is a mobile phone or tablet computer. It should be noted, however, that in other embodiments, the electronic device 10 could be something other than a mobile phone or tablet computer. For instance, in other embodiments, the electronic device could be a computer (e.g., laptop or notebook computer) or a wearable device, such as a fitness band or watch (e.g., smart watch).

In the illustrated embodiment, the electronic device 10 includes an outer boundary 100 in which the electronic display 18 is contained. For instance, the outer boundary 100 may include a body of the electronic device 10. The outer boundary 100 may be larger than the display. For example, as discussed below, some circuitry associated with the electronic display 18 may be included outside of the electronic display 18 but within the outer boundary 100.

As also shown in FIG. 11, the electronic device 10 includes rounded edges 102 and bezels 104. The rounded edges 102 and bezels 104 may include areas of the electronic device 10 that include the electronic display 18 as well as the outer boundary 100. For instance, the electronic display 18 may be absent from the bezels 104. With that said, portions of the electronic display 18 in the rounded edges 102 and near the bezels 104 may be rounded or angled. In other words, the electronic display 18 may be non-rectangular.

For example, portion 106, which includes some of the rounded edge 102, illustrates an edge 108 of the electronic display 18 as well as circuitry 110 associated with the electronic display 18. Portions of the circuitry 110 illustrated to the right of the edge 108 may be included in the electronic display 18 (e.g., physically located within the electronic display 18 as shown in FIG. 11), while portions of the circuitry that are shown to the left of the edge 108 may not be included in the electronic display 18.

As illustrated, the circuitry 110 includes columns 120 of pixels 122 that may be disposed along data lines 130. The columns 120 may include different numbers of pixels 122. For instance, as shown in FIG. 11, column 120A and column 120B each include three pixels 122, while column 120C and column 120D each have four pixels 122. Additionally, it should be noted that, in the illustrated embodiment, the pixels 122 of alternating columns 120 (and data lines 130) may be the same type of pixel. For example, the pixels 122 may be referred to as sub-pixels that may be associated with emitting light of one or more colors. For example, pixels 122 such as pixel 122A and pixel 122C may emit red light or blue light, while pixels 122 such as pixel 122C and pixel 122D may emit green light.

In the illustrated embodiment, data line 130B and data line 130D are coupled to comparator 92, which, as discussed above, may send a signal indicative of a difference between inputs received from the data line 130B and data line 130D to the compensation circuitry 30. In general, in the illustrated embodiment, alternating data lines 130, which correspond to alternating columns 120 of similar types of sub-pixels, may be coupled to comparators. In other words, in other embodiments, there may be more than one comparator 92, and other data lines, such as data line 130A and data line 130C may be coupled to one of the additional comparators.

The circuitry 110 also includes scan lines 132 that may form crossovers (e.g., intersections) with the data lines 130. The proximity of the scan lines 132 to the data lines 130 may introduce noise (e.g., caused by parasitic capacitance) to the data lines 130. While the compensation circuitry 30 may correct for the noise, when different amounts of noise are introduced to different data lines, the compensation provided may not accurately account for the noise due to the fact that there are two different amounts of noise present. Furthermore, it should be noted that while the circuitry 110 is illustrated, the electronic display 18 may include many more pixels 122, data lines 130, and scan lines 132. For example, there may be hundreds or thousands (or more) pixels 122, data lines 130, and scan lines 132 included in the circuitry 110 and display 18.

As noted above, the compensation circuitry 30 may compensate for noise within the circuitry 110. However, a data line 130 that forms fewer or more crossovers with scan lines 132 may have a difference amount of noise compared to another data line 130. For example, in some cases in which the electronic display 18 is rounded (e.g., rounded edge 102 or bezel 104), there may be fewer pixels 122 along a data line 130. More specifically, there may be fewer pixels in one column 120 compared to another column 120 due to the curve of the electronic display 18. For instance, in column 120D, there are four pixels, whereas column 120B includes three pixels 122. In some cases, data lines 130 may not extend from the last (e.g., closest to the edge 108) to a subsequent scan line 132. For example, in the illustrated embodiment, the data line 130A includes a portion 140A, and the data line includes a portion 140C. The portion 140A and portion 140C respectively extend from pixel 122A and pixel 122B to the scan line 132A such that the data lines 130A and 130B have the same number of crossovers with scan lines 132 as the data line 130C and data line 130D. Because there are the same number of crossovers (e.g., between data line 130B and data line 130D that are coupled to the comparator 92), the noise introduced (e.g., by the scan lines 132) to the data line 130 may be equivalent. Accordingly, the signals the comparator 92 receives may be indicative the same amount of noise, which will cancel out with one another. Accordingly, because noise introduced to the data lines 130B an 130D by the scan line 132A even though there are different numbers of pixel 122 on the data lines 130B and 130D may be equal, the noise may cancel out at the comparator 92, which may enable the compensation circuitry 30 to correct for the noise on both data lines 130B and 130D not caused by the scan line 132A.

Furthermore, it should be noted that some of the portion 140A and portion 140C may extend outside of the electronic display 18 but otherwise are still included in the electronic device 10. For example, the portion 140A and portion 140C may be quite small (e.g., micrometers in length) and included between the edge 108 of the display and the outer boundary 100 of the electronic device.

Figure 12:
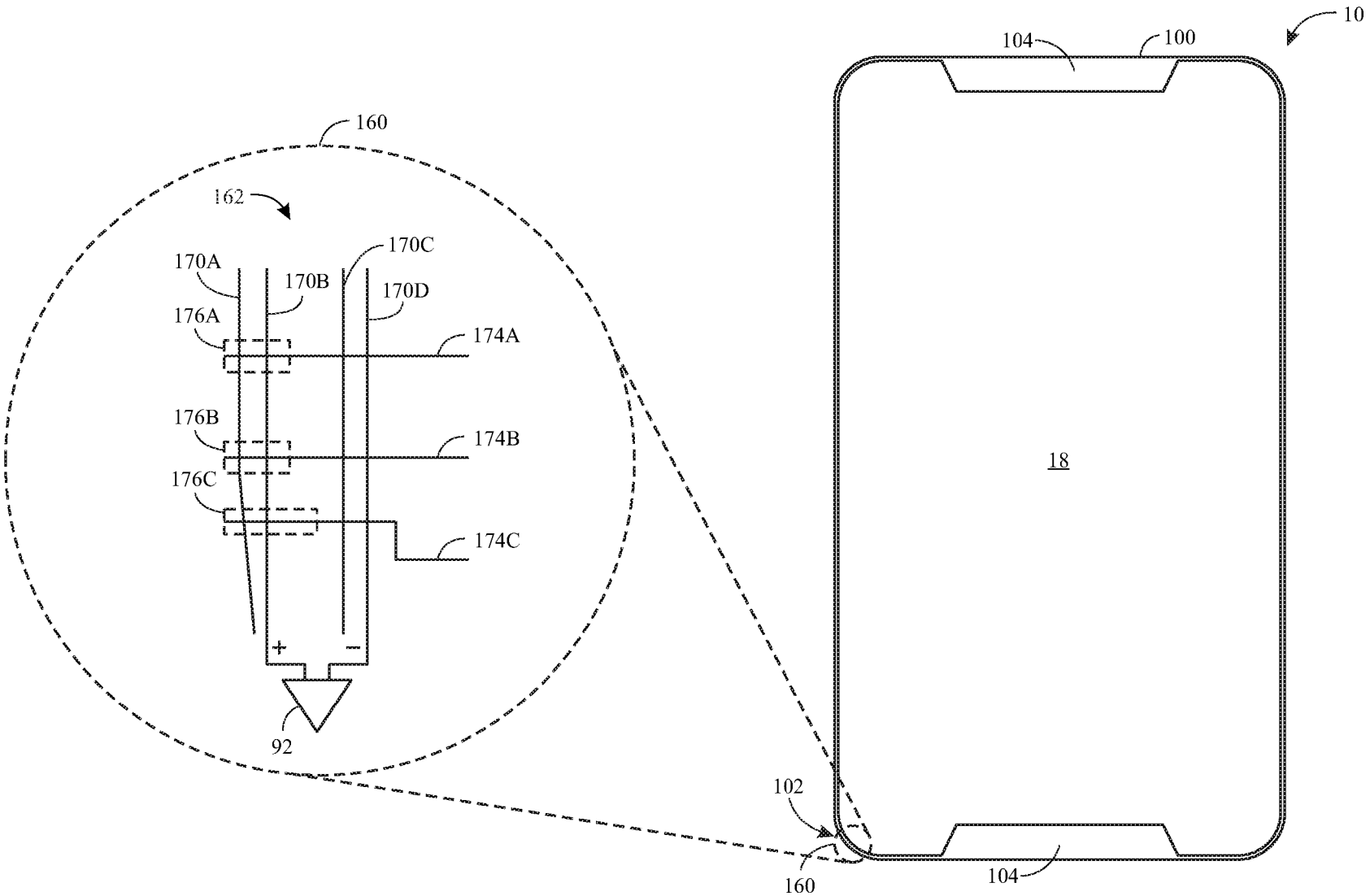
FIG. 12 illustrates the electronic device of FIG. 1 and circuitry that may be included within the electronic device, in accordance with an embodiment.

As another example, FIG. 12 illustrates circuitry 162 that may be included at least partially in the electronic display 18 of the electronic device 10. More specifically, the circuitry 162 may be associated another rounded edge 102 of the electronic device 10. In the illustrated embodiment, the circuitry 162 includes data lines 170A, 170B, 170C, and 170D, scan lines 174A, 174B, and 174C, and a comparator 92. Pixels may be coupled to, and located along, the data lines 170A, 170B, 170C, and 170D. For instance, data line 170A and data line 170C may include pixels of one or more types of subpixels (e.g., red and blue subpixels), while data line 170B and data line 170D may include another type or types of subpixels (e.g., green subpixels).

Some of the data lines 170A, 170B, 170C, and 170D, or portions thereof, may not be included in the electronic display 18. Such data lines 170A, 170B, 170C, and 170D, or portions thereof, may not include pixels. For example, portions of data line 170A and data line 170B may not be included in the electronic display 18, but rather included between the electronic display 18 and the outer boundary 100 of the electronic device 10. Likewise, portions of the of scan lines 174 may not be include in the electronic display 18. For instance, portions 176 may be included between the electronic display 18 and the outer boundary 100 of the electronic device 10.

As shown in FIG. 12, data line 170B and data line 170D are coupled to the comparator 92. The comparator 92 may receive signals from the data line 170B and data line 170D and generate a signal indicative of a difference (e.g., difference in voltage, current) between the signals received from the data line 170B and data line 170D. The compensation circuitry 30 may receive the signal from the comparator 92, and the compensation circuitry 30 (and/or processor core complex 12) may cause data (e.g., image data) sent to the pixels of the data lines 170 to be modified to compensate for differences in the signals from the data line 170B and data line 170D. However, as described above, when there is a difference number of crossovers between data lines 170A, 170B, 170C, and 170D, such as the data line 170B and the data line 170D, and scan lines, such as scan lines 174A, 174B, and 174C, a parasitic capacitance between the data line 170B and a scan line (e.g., scan line 174C) differs from a parasitic capacitance 96B between the data line 170D and the scan line (e.g., scan line 174C), unequal noise due to a scanning signal ($\Delta$Vscan) on the scan line 98 may arise. For example, first noise due to a first charge may occur on the data line 170B that may differ from second noise due to a second charge on the data line 170D. Since this noise is unequal, the noise will not cancel out in the comparator 92. Accordingly, the compensation circuitry 30 may not completely compensate for noise experienced by both data line 170B and data line 170D.

By including the portions 176A, 176B, and 176C of the scan lines 174A, 174B, and 174C, data line 170B and data line 170D have the same number of crossovers with the scan lines 174A, 174B, and 174C. Accordingly, common mode noise that appears on both of the data lines 170B and 170D (e.g., due to a common environmental noise source, such as display scanning signals or electromagnetic interference (EMI) from other circuitry of the electronic device 10) may be substantially the same on the scan lines 174A, 174B, and 174C, and thus this common mode noise may cancel out in the comparator 92. By enabling noise common to the data lines 170B and 170D to be canceled out, the compensation circuitry 30 may receive signals indicative that are relatively more accurate, which enables the compensation circuitry to more effectively compensate for noise. Because the noise may be accurately accounted for, image data presented on the electronic display 18 may have fewer inconsistencies, such as visual artifacts that may be caused by inaccurate compensation.

Furthermore, it should be noted that while FIG. 11 and FIG. 12 are directed to rounded edges 102, the techniques illustrated therein and discussed above may be applied to any portion of the electronic display 18, such as the bezels 104. For example, while there may not be any pixels (e.g., pixels 122) in the bezels 104, there may be data lines and/or scan lines that are included in the bezel 104 to enable the same number of crossovers to achieved for pixels that share an amplifier (e.g., comparator 92). Furthermore, it should be noted that while the discussion above is in reference to an electronic device (e.g., electronic device 10) with rounded edges (e.g., rounded edges 102) and angled bezels 104 (e.g., bezel 104 that include an oblique angle), the presently disclosed techniques may be used in other embodiments of the electronic device 10, such as embodiments in which the edges and/or bezels 104 may differ from those illustrated in FIG. 11 and FIG. 12. For example, the presently disclosed techniques may be applied to embodiments of the electronic device having angled edges, differently shaped (e.g., rounded) bezels 104, a different number and/or placement of the bezels 104, or any combination thereof. In other words, the techniques discussed herein may be applied to a variety of different types of displays and electronic devices, especially those having columns of pixels that have different amounts of pixels.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device, comprising:

a display, comprising:

a rounded edge of the display;

a plurality of scan lines, wherein:

the plurality of scan lines comprises a first scan line and a second scan line;

the second scan line is a branch of the first scan line; and the second scan line is disposed at least partially in the rounded edge and extends into a portion of the electronic device exterior to the display;

a first data line comprising a first number of pixels, wherein the first data line is disposed at least partially in the rounded edge, extends into a portion of the electronic device exterior to the display, and forms a first number of crossovers with the plurality of scan lines; and a second data line comprising a second number of pixels different than the first number of pixels, wherein the second data line is not disposed in the rounded edge of the display forms a second number of crossovers with the plurality of scan lines, and wherein the second number of crossovers is equal to the first number of crossovers.

2. The electronic device of claim 1, comprising sensing circuitry configured to sense a property of the first data line and the second data line.

3. The electronic device of claim 2, comprising a comparator coupled to the first data line and the second data line and configured to generate a signal indicative of a difference between the property of the first data line and the second data line.

4. The electronic device of claim 3, comprising compensation circuitry configured to compensate image data based on the difference.

5. The electronic device of claim 3, wherein the display comprises a third data line disposed between the first data line and the second data line.

6. The electronic device of claim 1, wherein the display comprises one or more rounded bezels.

7. The electronic device of claim 6, wherein the first scan line is disposed in the rounded edge and extends into the portion of the electronic device that is exterior to the display.

8. The electronic device of claim 6, wherein at least a portion of the plurality of scan lines is disposed in a portion of the one or more rounded bezels and extends into the portion of the electronic device that is exterior to the display.

9. The electronic device of claim 1, comprising a third data line positioned adjacent to the first data line, wherein the third data line only forms crossovers with a portion of the plurality of scan lines that does not include the first scan line and the second scan line.

10. A non-transitory, computer-readable medium comprising instructions that, when executed, are configured to cause circuitry to sense a property of a first data line comprising a first number of pixels of a display of an electronic device and a second data line comprising a second number of pixels of the display, wherein:

the second number of pixels differs from the first number of pixels;

the display comprises a plurality of scan lines that form an equal number of crossovers with the first data line and the second data line;

the plurality of scan lines comprises a first scan line and a second scan line;

the second scan line is a branch of the first scan line;

the second scan line is disposed at least partially in a rounded edge of the display and extends into a portion of the electronic device exterior to the display; and the first data line is disposed at least partially in the rounded edge of the display and extends past the rounded edge into a portion of the electronic device exterior to the display.

11. The non-transitory, computer-readable medium of claim 10, wherein the display comprises a comparator coupled to the first data line and the second data line, wherein the comparator is configured to generate a signal to provide an indication of noise associated with the first data line and the second data line.

12. The non-transitory, computer-readable medium of claim 10, wherein:

the display comprises one or more bezels; and the second data line is disposed in neither the rounded edge nor the one or more bezels.

13. The non-transitory, computer-readable medium of claim 10, wherein:

the first data line comprises a first pixel;

the second data line comprises a second pixel; and the first and second pixels are a first type of sub-pixel.

14. The non-transitory, computer-readable medium of claim 13, wherein the display comprises a third pixel disposed along a third data line, wherein the third pixel is a second type of sub-pixel different than the first type of sub-pixel.

15. The non-transitory, computer-readable medium of claim 10, wherein the instructions are configured to cause compensation circuitry to:

compensate for noise associated with the first data line and the second data line by modifying image data; and send the modified image data to one or more pixels of the first and second data lines.

16. An electronic device comprising:

a body comprising at least one rounded edge;

a non-rectangular display disposed within the body, wherein the display comprises:

a rounded edge of the display;

a plurality of scan lines, wherein:

the plurality of scan lines comprises a first scan line and a second scan line;

the second scan line is a branch of the first scan line; and the first scan line and second scan line are disposed at least partially in the rounded edge of the display and extend into a portion of the electronic device exterior to the display;

a first data line comprising a first number of pixels, wherein the first data line is disposed at least partially in the rounded portion, extends into the portion of the electronic device exterior to the display, and forms a first number of crossovers with the plurality of scan lines; and a second data line comprising a second number of pixels different than the first number of pixels, wherein the second data line forms a second number of crossovers with the plurality of scan lines, wherein the second number of crossovers is equal to the first number of crossovers; and sensing circuitry comprising a comparator coupled to the first data line and the second data line, wherein the comparator is configured to generate a signal indicative of a difference between a property of the first data line and the second data line without additional noise that would be caused by a lack of equality between the first number of crossovers and the second number of crossovers.

17. The electronic device of claim 16, comprising a bezel, wherein a portion the plurality of scan lines is disposed beneath the bezel.

18. The electronic device of claim 16, wherein the second scan line comprises more pixels than the first scan line.

19. The electronic device of claim 16, comprising compensation circuitry configured to compensate image data based on the difference in the property of the first data line and the second data line.

20. The electronic device of claim 16, wherein the electronic device comprises a mobile phone, a tablet computer, or a wearable electronic device.

* * * * *